US005082287A

United States Patent [19]

Nwanna

[11] Patent Number: 5,082,287

[45] Date of Patent: Jan. 21, 1992

[54] APPARATUS FOR A GAME

[76] Inventor: Dozie C. B. Nwanna, c/o David Garrick & Co., Investment House, 21-25 Broad Street, Lagos, Nigeria

[21] Appl. No.: 561,260

[22] Filed: Jul. 30, 1990

Related U.S. Application Data

[63] Continuation of Ser. No. 232,447, Aug. 15, 1988, abandoned, which is a continuation-in-part of Ser. No. 930,801, Nov. 14, 1986, abandoned.

[30] Foreign Application Priority Data

Nov. 22, 1985 [NG] Nigeria ..... 9398/85

[51] Int. Cl.[5] ..... A63F 3/00

[52] U.S. Cl. ..... 273/241; 273/282

[58] Field of Search ..... 273/241, 255, 262, 276, 273/282, 283, 284, 287, 290

[56] References Cited

U.S. PATENT DOCUMENTS

| | | | |
|---|---|---|---|
| D. 169,400 | 4/1953 | Wales | 273/290 X |
| 179,483 | 7/1876 | Lewis | 273/290 |
| 1,165,688 | 12/1915 | Maris | 273/283 X |
| 2,168,659 | 6/1918 | Wright | 273/290 |
| 2,534,055 | 12/1950 | Peterson | 273/290 |
| 2,703,713 | 3/1955 | Moyer | 273/290 X |
| 2,896,950 | 7/1959 | Rosti et al. | 273/290 X |
| 3,186,716 | 6/1965 | Shabarick | 273/290 |
| 3,692,310 | 9/1972 | Martin | 273/241 |
| 3,806,124 | 4/1974 | Ippen et al. | 273/241 |
| 3,871,657 | 3/1975 | Lorenz et al. | 273/290 X |
| 3,993,313 | 11/1976 | Tillston | 273/241 x |
| 4,348,027 | 9/1982 | Escamilla-Kelly | 273/241 |
| 4,552,363 | 11/1985 | Rekkenper et al. | 273/241 |

FOREIGN PATENT DOCUMENTS

| | | | |
|---|---|---|---|
| 2645412 | 10/1976 | Fed. Rep. of Germany . | |
| 2260365 | 9/1975 | France | 273/264 |

*Primary Examiner*—Edward M. Coven
*Assistant Examiner*—William E. Stoll
*Attorney, Agent, or Firm*—Darby & Darby

[57] ABSTRACT

The present invention relates to an apparatus for playing a game comprising a base and a plurality of platforms in three independent varieties of sufficient number to cover the base and a set of playing pieces in two independent varieties. The first variety of platforms 3 have shoulders around their top edges and hollowed bottoms whereby they can be built up on top of each other. The second variety of platforms are in four height categories which each correspond with orders of the first variety as follow: a single platform standing on its own; two platforms built up together; three platforms built up together; and four platforms built up together. The third variety of platforms corresponds to four platforms of the first variety built up together and is provided with a vertical telescopic foot which slidingly engages the base. All the varieties of platforms are divided into subsets of platforms of different top face colours. Structures of varying levels can be formed with the various varieties of platforms by building up, placing side by side or sliding adjustment of the telescopic foot, as applicable, each level of the structure having its own given top-face colour of colours.

8 Claims, 9 Drawing Sheets

APPARATUS FOR A GAME

This is a continuation of application Ser. No. 232,447, filed Aug. 15, 1988, now abandoned, which is a continuation-in-part of Ser. No. 930,801, filed Nov. 14, 1986 (now abandoned).

BACKGROUND OF THE INVENTION

The present invention relates to the apparatus for playing a game.

It was intended that the pieces should not only resemble materials of the modern military which they represent, but which should also be assigned specific values and features which allow them to approximate to the utmost the natural characteristics of these materials.

It was also intended that the game should be played on a surface with such features that enable it to realistically represent the ground, water and air; all of which form the arena of the modern warfare.

SUMMARY OF THE INVENTION

Accordingly, there is provided an apparatus for a game comprising a set of pieces representing various operational organizations of the modern military, airforce and navy in two independent varieties (the one as models of warplanes, military tank, missile rocket, submarine and warship and the other as rectangular blocks bearing any of their representative images on their tops), a set of platforms in three independent varieties and a board wherein the platforms can be arranged on the board in rows and placed (in vertical arrangement, one on top of another, side-by-side with one another, or standing on telescopic feet, depending on the variety of platforms concerned) to represent different altitudes of terrain and wherein a piece can be positioned upon a platform provided that the piece is allocated with such features which allow the piece to be located on that particular platform. The upper face of a platform is the axis.

BRIEF DESCRIPTION OF THE DRAWINGS

A preferred embodiment of the present invention will now be described in detail, by example only, with reference to the accompanying drawings, in which.

DESCRIPTION OF THE PREFERRED EMBODIMENTS

Figure 1:
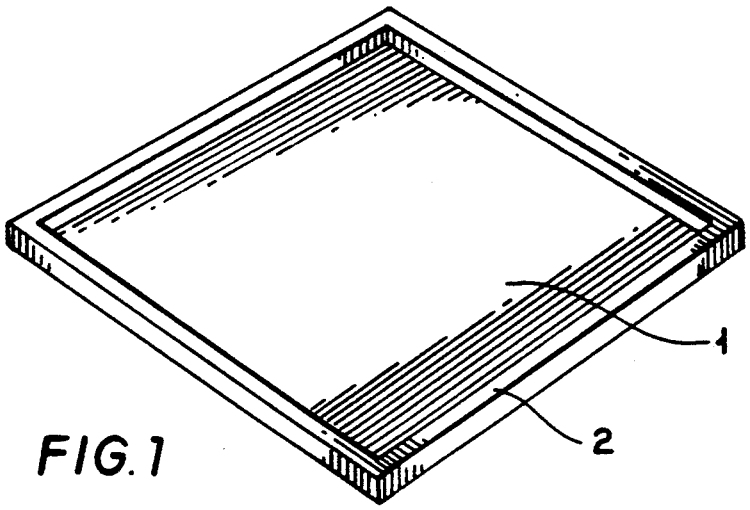
FIG. 1 shows a board on which platforms are positioned.

Before the various units shown in the drawings are described in detail it is necessary to define the terms echelon, commissioning, consistency, and valency in order that there is complete understanding of the features allocated to each unit.

Figure 16A:
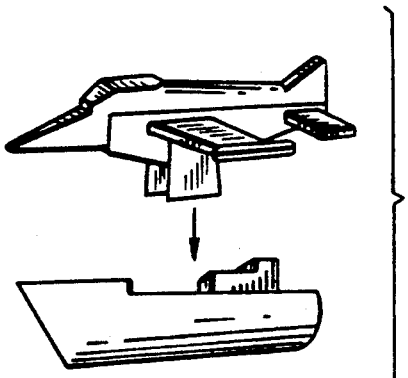
FIGS. 16A and 16B show pieces of the first variety before and after vertical combination in echelon.
Figure 16B:
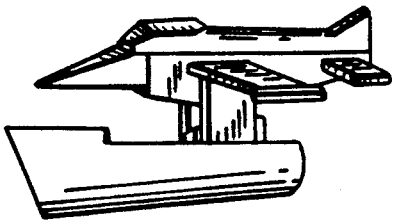
Figure 17A:
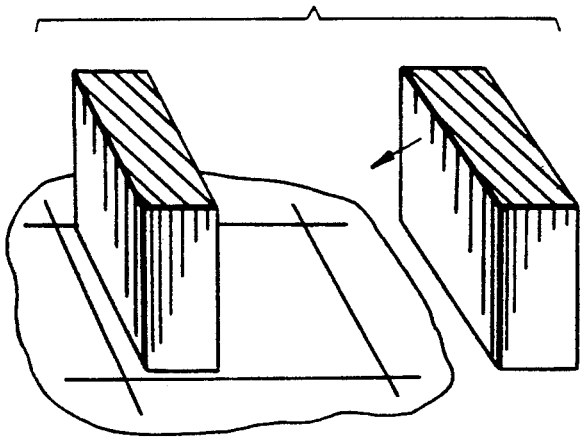
FIGS. 17A and 17B show pieces of the second variety before and after side-by-side combination in echelon.
Figure 17B:
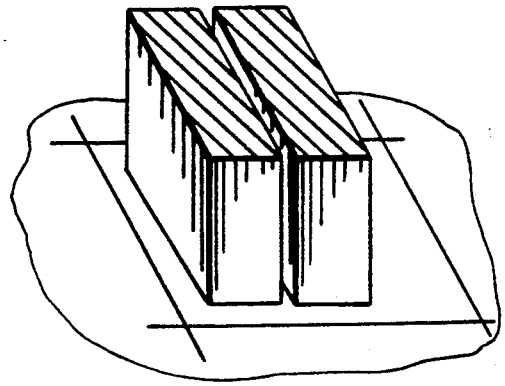

An echelon is the tactical union of two or more units which permits them to be located on a common axis and to be transferred in that formation as a single unit. In the echelon, the constituent units are placed one upon another, with the last arriving unit on top or to the right as shown in: FIGS. 16A and 16B and 17A and B, respectively. The top-most unit or the one most to the right in an echelon is referred to as a critical unit and the unit or units under it as connector. Two types of echelon are possible:

a. The echelon of identical units (i-echelon) which may comprise a maximum of three units; and b. The echelon of un-identical units (u-echelon) which may comprise only two units.

The initial placement of units on axes at the beginning of a game is referred to as commissioning.

Figure 18:
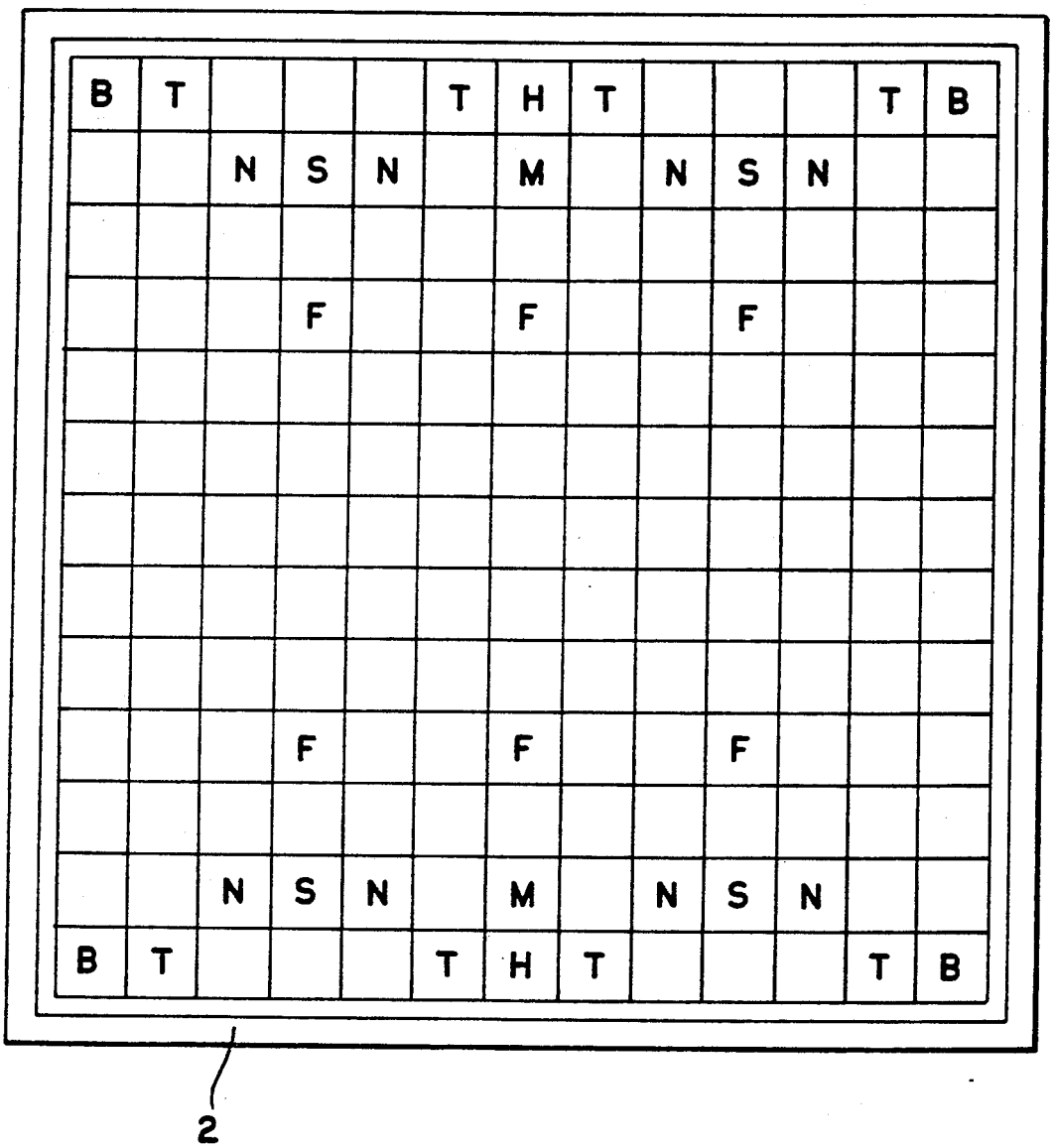
FIG. 18 shows commissioning of the units in the symmetry embodiment of the game.

Units may only be commissioned to axes within each player's own half of the board. Each type of unit may be represented on both sides of a game; the units of one side shall be of one colour and those of the other side another colour for purposes of distinction. An echelon of the M cannot be formed during commissioning. In symmetry, the units are commissioned on specific axes as shown in FIG. 18. In Scramble, the units are commissioned one at a time in alternate turns, while ensuring that no unit is placed on an axis from where it may directly threaten any unit of the opposite side with an offence.

Each unit is given a consistency which is defined in the following way:

(i) The unit is specific to port, channel or field, thereby becoming consistent only on such an axis.

(ii) The unit can be commissioned or transferred only onto an axis with which it is consistent;

(iii) However, a unit may over-come the limitation of its consistency if it is associated in appropriate union with another unit which has the desired consistency; and by this union be permitted to locate on an axis with which it was not naturally consistent;

(iv) Key-points have dual consistency; acting as both field and port.

Valency is a three-digit number expressing the utility of a unit. Each digit of the valency expresses the worth assigned to the unit in terms of particular features such as the relative capacities for offence, for inflicting damage during an offence and for transfer between axes.

The first digit of the valency denotes the relative capacity for offence of the unit and is referred to as the charge. A unit is said to be higher, lower or equal to another depending on their relative charges—the lesser the numeric value of the charge the stronger the unit. The lower unit defers to a higher one of the opposing side whenever an interposition occurs. Any unit may freely move over another friendly unit, but it may transgress only a lower opposing unit or an equal one to whose offence it could not be liable.

The second digit of the valency denotes the relative capacity to inflict damage during an offence of the unit and shall be referred to as the offence potential; the sum of the offence potentials of all the units on any side at any time is the force of that side.

The third digit of the valency denotes the relative capacity for transfer of the unit and shall be referred to as the manoeuvrability. The value of the manoeuvrability of a unit is equal to its range (i.e. the maximum number of axes over which the unit may be moved). However, the unit whose manoeuvrability value is "9" shall have range of 14 axes.

Although the M has no manoeuvrability it may be moved from an echelon already entered to form echelon with a unit at an immediate neighbouring axis.

For echelons, valency is deduced in terms of the resultants of particular dispositions as follow:

a. In the echelon of identical units, the charge is equal to the relative progression or the sum of charges of the constituent units; the offence potential is equal to the sum of the offence potentials of the constituent units; and the manoeuvrability is equal to that of one of the constituent units; and b. In the echelon of un-identical units, the charge is equal to that of the higher unit, or to that of one if both are equal; the offence potential is equal to the sum of the offence potentials of the constituent units; and the manoeuvrability is equal to the manoeuvrability of the unit consistent with the axis on which the echelon is located or that of the unit with lesser manoeuvrability if both are consistent with the axis. However, in the echelon of H with T the manoeuvrability shall be equal to that of the H, and in any echelon of the M, the manoeuvrability is that of the other unit. The R has a valency notation of "OXY"; the "O" depicting that it has no charge, the "X" representing an offence potential of 15 points and the "Y" denoting an unlimited range.

Figure 2A:
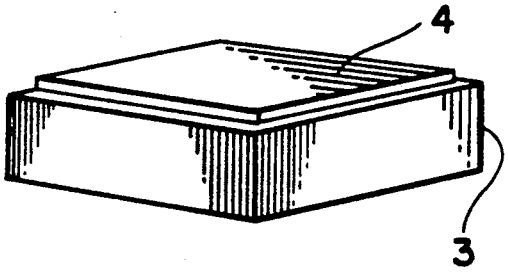
FIG. 2A is a top perspective view of the first variety of platform.
Figure 2B:
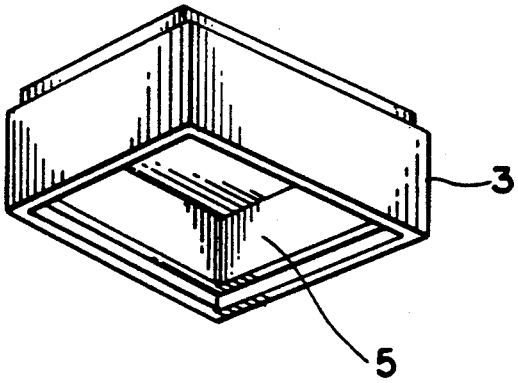
FIG. 2B is a bottom perspective view of the first variety of platform.
Figure 3D:
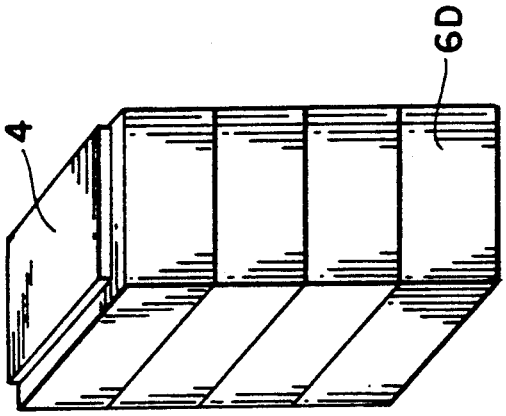
FIG. 3D is a top perspective view of the fourth category of the second variety of platforms.
Figure 3C:
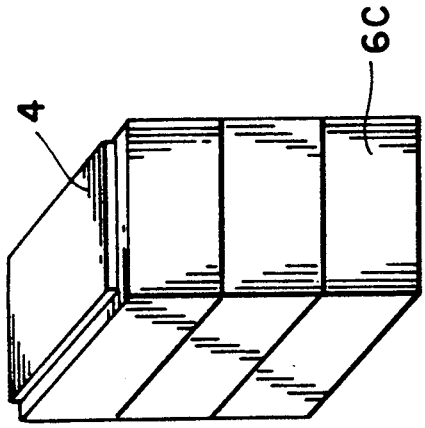
FIG. 3C is a top perspective view of the third category of the second variety of platforms.
Figure 3B:
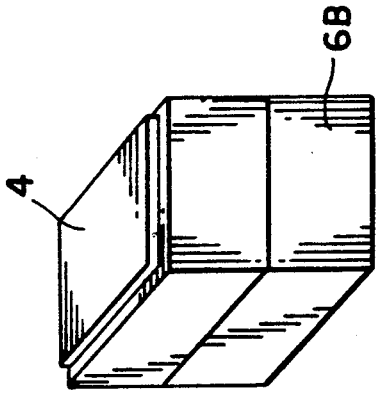
FIG. 3B is a bottom perspective view of the second category of the second variety of platforms.
Figure 3A:
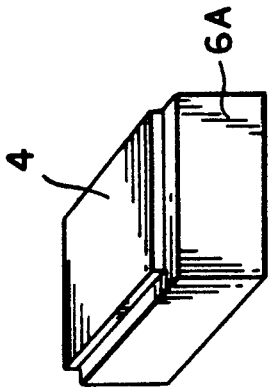
FIG. 3A is a top perspective view of the first category of the second variety of platforms.
Figure 4:
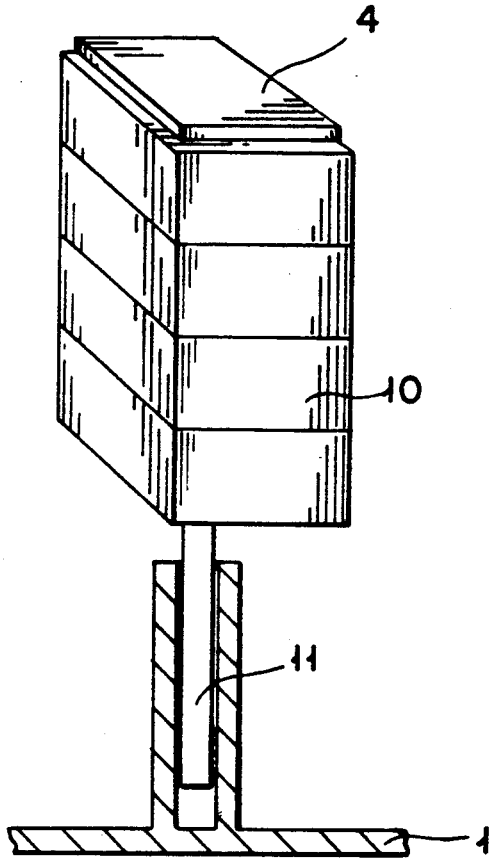
FIG. 4 is the top perspective view of the third variety of platforms.
Figure 5:
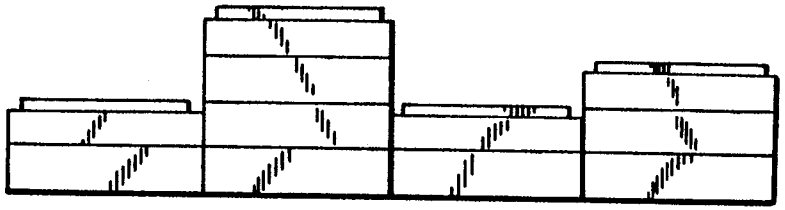
FIG. 5 shows platforms of the first variety in vertical arrangement or the platforms of the second variety arranged side by side.

The board for playing the game is shown in FIG. 1 and is referred to as theatre. The theatre comprises a surface 1 upon which rectangular, square-topped platforms are set in tight rows. The square top-face 4 of each platform is referred to as axis, it is on an axis that a unit may be located. A rim 2 surrounds the surface 1. The platforms are in three independent varieties as follows (a) FIGS. 2A and 2B show top and bottom perspective view of the first variety of platforms 3. This variety of platforms 3 is hollowed into a mortice 5. In FIG. 5 the platforms have been placed on top of each other to represent various levels of terrain. As shown in FIG. 2(A) the height of a platform is less than the lateral dimension;

(b) FIGS. 3A, 3B, 3C and 3D, show side perspective view of the categories of second variety of platforms 6A, 6B, 6C and 6D respectively. In the FIG. 5, the platforms of various heights have been placed besides one another in a tight row, representing various levels of terrain;

(c) FIG. 4 shows a side perspective view of the third variety of platforms 10. Each platform of this variety is provided with a telescopic foot 11, whereby it can be retracted or extended along the vertical plane. In the FIG. 6, the platforms 10 of equal height stand on their telescopic feet 11 which are set at various height positions to represent various levels of terrain.

Figure 7:
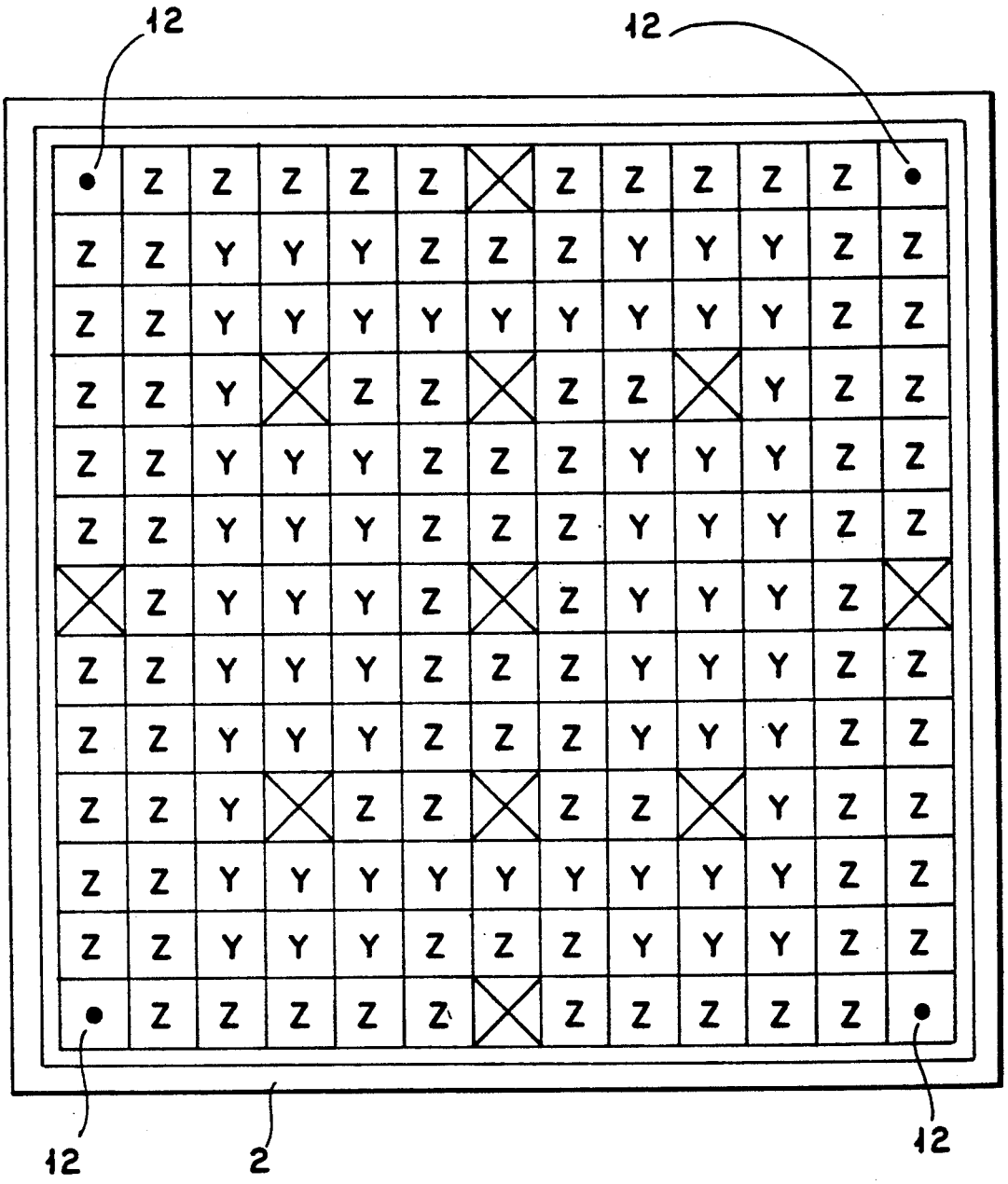
FIG. 7 shows the board on which platforms have been allocated a letter reference to distinguish one type of axis from another.

As shown in FIG. 7, an axis may be light brown (x), grey (y) or dark brown (z) in colour; a light-brown axis (x) shall be referred to as a port, while the grey (y) and the dark brown (z) axes are referred to as a channel and a field, respectively. The remaining axes 12 are called key-points. All the platforms 3 are located on the flat surface 1 of the board and the rim 2 holds the platforms in place.

One embodiment of the present invention is played on a standard theatre of 169 (13 columns and 13 rows) level axes as shown in FIG. 7 and is referred to as symmetry. In symmetry, the two axes at the corners on each side of the theatre are the key-points 12 and are designated by an axis with a dot at its centre as shown in FIG. 7.

A further embodiment of the present invention is played on a standard theatre of 196 axes (14 columns and 14 rows) of any arrangement; and is referred to as scramble. At the beginning of scramble both sides decide on the arrangement of the platforms in a suitable terrain, or they may ballot to chose sides from a predetermined terrain arrangement before commissioning.

Figure 6:
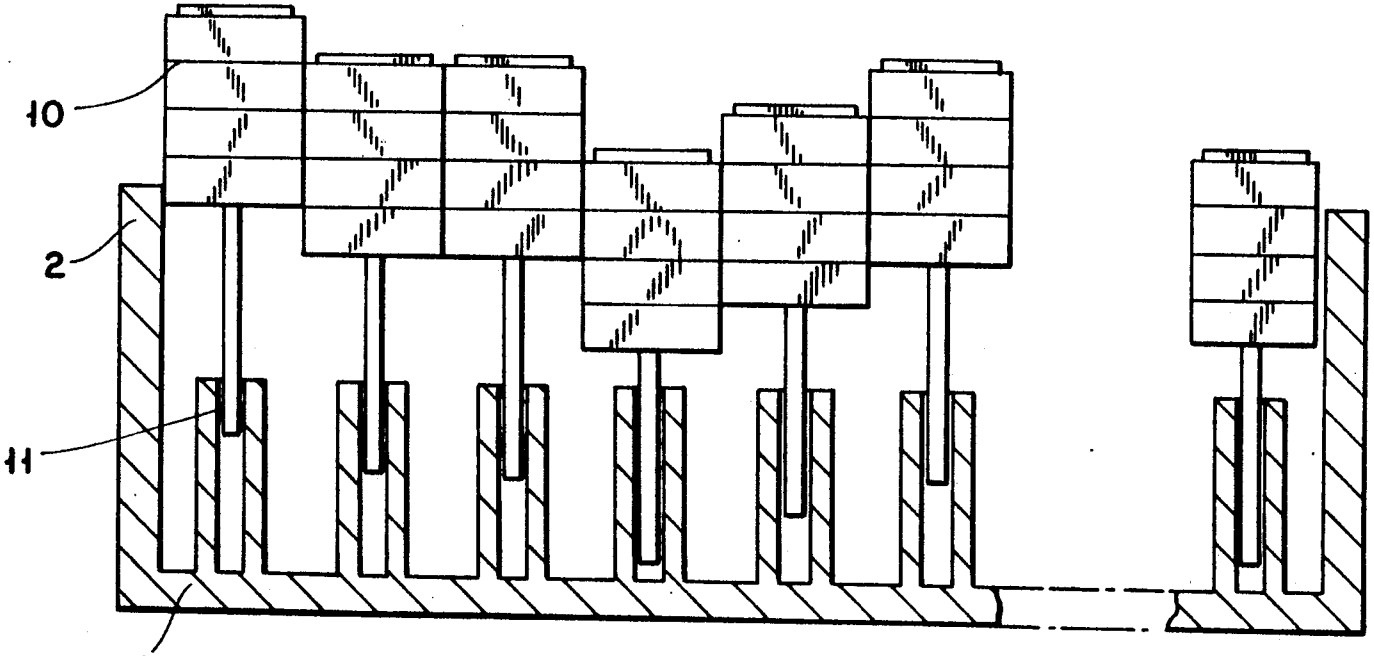
FIG. 6 shows platforms of the third variety standing on their telescopic feet.

The various varieties of platform may each be arranged to depict terrain by: placing platforms of the first variety on top of one another (as shown in FIG. 5) appropriate categories of the second variety side by side one another as also represented by (FIG. 5) or by adjustment of the foot of relevant platforms of the third variety (as shown in FIG. 6).

There are only four altitude levels;

a. 1st level: only a channel may be represented at this level;

b. 2nd level: both the ports and the field may be represented at this level;

c. 3rd level: both the ports and the field may be represented at this level; and d. 4th level: only the field may be represented at this level.

In scramble, only one axis is designated by each side as its key-point. In Scramble, two or more ports adjoining together and of the same altitude level are collectively referred to as a complex. Depth can be represented in a channel by axes with a deeper shade of the grey (y) colour; any such axis shall be referred to as deep.

A side may convert a field into a port (to be referred to as importation) or a port to a field (to be referred to as deportation) by the substitution of the relevant platform at any point in scramble, but such substitution shall be done as follows:

(a) During the sides's turn of play and one platform per turn;

(b) The side shall have at least one of its units located on an axis or complex adjacent to the one to be converted;

(c) Not more than ten times by a side in one game.

The theatre for Scramble may be reduced beyond the "standard" dimension of 14 columns and 14 rows; but the force to be deployed on each shall be calculated in due proportion of the standard "70 points".

The pieces are termed units; the eight types represent various operational organisations of the modern military, airforce and navy and are only symbolically modelled after the Helicopter military transport/gunship; Submarine; Bomber aircraft; Fighter aircraft; Warship; Man Battle Tank; Missile rocket; Mid-Air Refueller Aircraft as shown in FIGS. 8A to 15A and 8A to 15B.

Figure 8A:
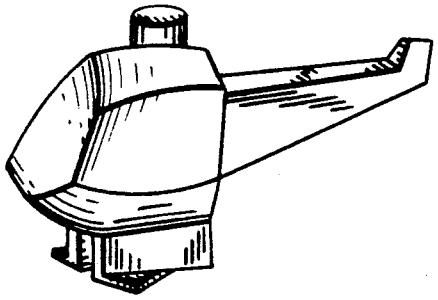
FIG. 8A shows a helicopter piece (H) of the first variety.
Figure 8B:
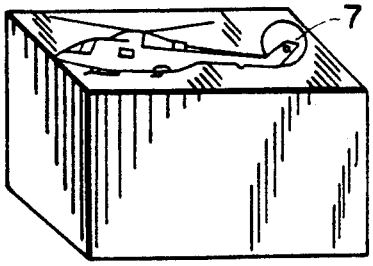
FIG. 8B shows a helicopter piece (H) of the second variety.

The H shown in FIG. 8A and 8B has the following features:

a. Consitent with the field and port;

b. Valency of 369;

c. Possible directions for movement; backwards, forwards, sideways and diagonally along a straight line joining corners of adjacent axes.

d. Shall not enter an echelon of identical units;

e. May initiate an echelon of unidentical units with: N and T: and f. Has an offence capability to which the following units may be liable: S, N, M and R.

Figure 9A:
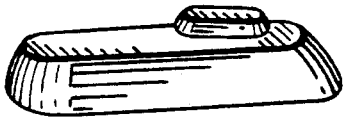
FIG. 9A shows a submarine piece (S) of the first variety.
Figure 9B:
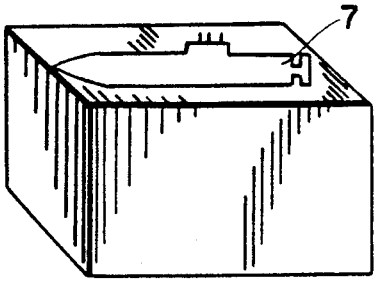
FIG. 9B shows a submarine piece (S) of the second variety.

The S shown in FIG. 9A and 9B has the following features:

a. Consistent with the channel;

b. Valency of 351;

c. Possible directions for movement forwards, backwards sideways and diagonally along straight lines joining corners of adjacent axes;

d. Shall not enter an echelon of identical units;

e. Shall not initiate an echelon of un-identical units;

f. May exert an orbit influence to which only N is liable; (for orbit influence see later)

Figure 10A:
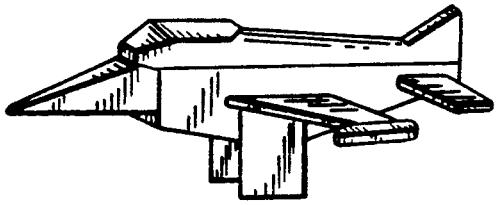
FIG. 10A shows a bomber piece (B) of the first variety.
Figure 10B:
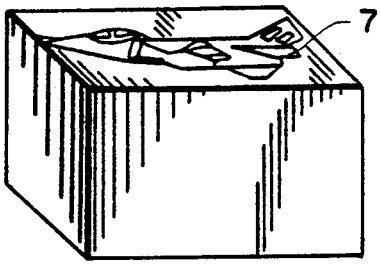
FIG. 10B shows a bomber piece (B) of the second variety.

The B shown in FIG. 10A and 10B has the following features:

a. Consistent with the ports, b. Valency of 236, c. Possible directions for movement: forwards, backwards sideways and diagonally along straight lines joining corners of adjacent axes;

d. May enter an echelon of identical units, e. May initiate an echelon of unidentical units, with: T, N and T, and f. Has an offence capability to which the following are liable: N, T, and M.

Figure 11A:
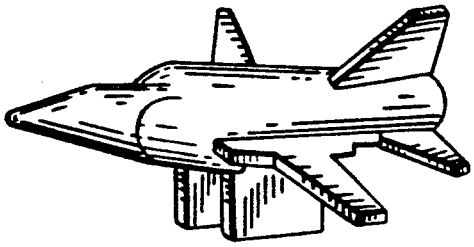
FIG. 11A shows a fighter piece (F) of the first variety.
Figure 11B:
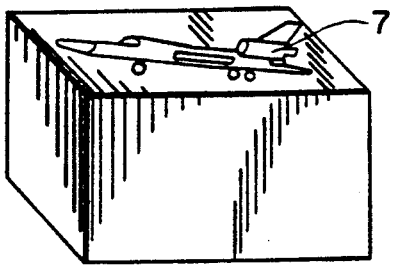
FIG. 11B shows a fighter piece (F) of the second variety.

The F shown in FIG. 11A and 11B has the following features:

a. Consistency with the ports, b. Valency of 129;

c. Possible directions for movement; forward, backwards, sideways, and diagonally along straight lines joining corners of adjacent axes;

d. May enter an echelon of identical units;

e. May initiate an echelon of un-identical units with B, N and T; and f. Has an offence capability to which all types of units are liable.

Figure 12A:
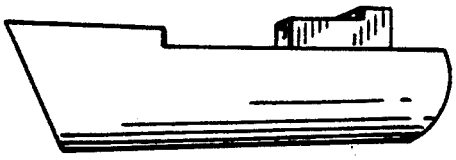
FIG. 12A shows a warship piece (N) of the first variety.
Figure 12B:
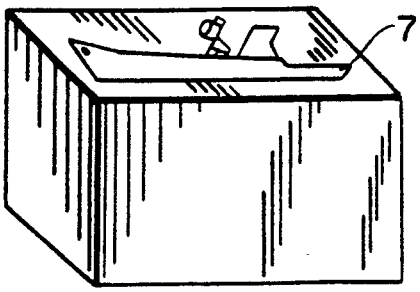
FIG. 12B shows a warship piece (N) of the second variety.

The N shown in FIG. 12A and 12B has the following features:

a. Consistent with the channel;

b. Valency of 623;

c. Possible directions for movement: forward, backward and sideways, d. May enter an echelon of identical units, e. May initiate an echelon of un-identical units with only the S, f. Has an offence capability to which the N, and M are liable; and g. May exert an axial effect to which only the applicable units may be liable; (for axial effect see later)

Figure 13A:
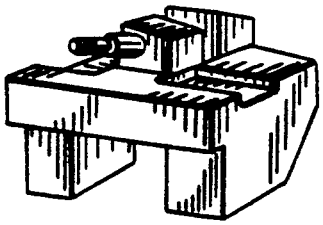
FIG. 13A shows a military tank piece (T) of the first variety.
Figure 13B:
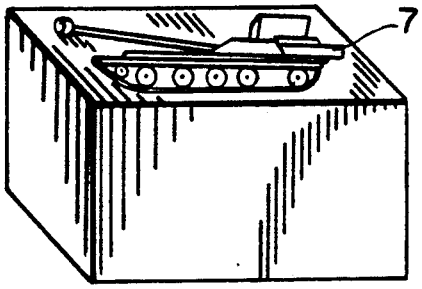
FIG. 13B shows a military tank piece (T) of the second variety.
Figure 14A:
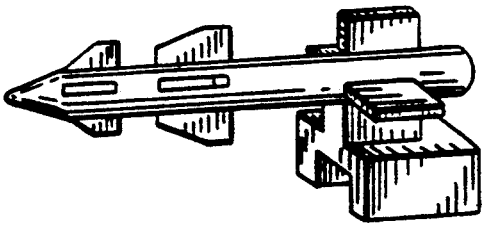
FIG. 14A shows a missile rocket piece (M) of the first variety.
Figure 14B:
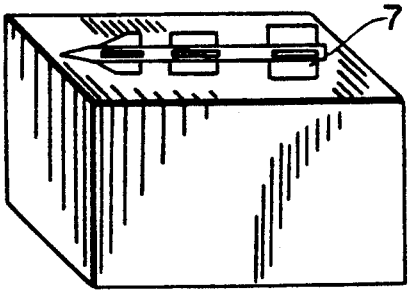
FIG. 14B shows a missile rocket piece (M) of the second variety.

The T shown in FIG. 13A and 13B has the following features:

a. Consistent with the field;

b. Valency of 821;

c. Possible directions for movement: forwards, backwards, sideways, diagonally along straight lines joining corners of adjacent axes;

d. May enter an echelon of identical units;

e. May initiate an echelon of un-identical units with only the N;

f. Has an offence capability to which the T and M are liable; and g. May exert an axial effect to which any unit may be liable;

The M shown in FIG. 14A and 14B has the following features:

a. Consistency with the field, b. Valency of 090;

c. Possible directions for movement: forwards, backwards, sideways and diagonally along straight lines joining corners of adjacent axes (only for launching of ultimate (see later) since the unit has no manoeuvrability);

d. Shall not enter echelon of identical units;

e. May "initiate" echelon of un-identical units with S, B, N and T;

f. Has no offence to which any unit may be liable; but g. May exert orbit influence to which any unit from both sides shall be liable.

Figure 15A:
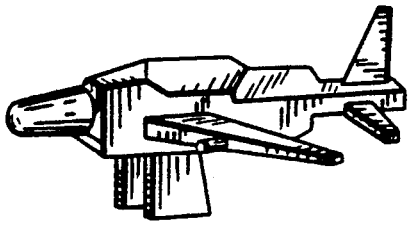
FIG. 15A shows a mid-air Refuelling piece (R) of the first variety.
Figure 15B:
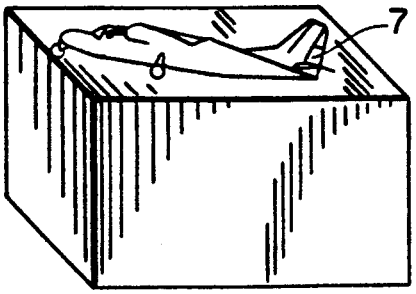
FIG. 15B shows a mid-air Refuelling piece (R) of the second variety.

The R shown in FIG. 15A and 15B has the following features:

a. Consistency with the ports;

b. Valency of "OXY", c. Possible directions of movement: may move in one or two leaps, in not more than two directions, forwards, backwards, sideways and diagonally along straight lines joining corners of adjacent axes;

d. May not enter echelon of identical units;

e. May initiate echelon of un-identical units with F and B.

The object of the game is as follows:

(i) Each of the two sides in the game aim at achieving over-all control of the theatre through actions performed with units during alternating turns of play.

(ii) If any side loses in the ensuing struggle for control of the theatre, it shall surrender. A side shall declare its surrender, thereby accepting defeat, if:

(a) Its key-points become occupied; or (b) Its force reduces beyond 18 points.

A stalemate shall be declared, whereby the game is discontinued and started afresh if:

(a) The two sides, in three consecutive turns each, transfer the same units between two particular axis or (b) At the end of the first 35 moves by each side, no hostile move (see later) has been conducted.

A move is any action undertaken by a unit on the theatre and corresponds to one turn of play. The move is legitimate only if it was made at the turn of play of the relevant side, along straight lines and in accordance with the valency and consistency of the unit involved.

Five categories of moves shall be possible, namely, manoeuvre, occupation, offence, orbit-influence and axial-effect the last three of which are collectively termed Hostile moves.

The manoeuvre is defined as follows:

(i) A manoeuvre is any non-hostile transfer of a unit from one axis to another as an operation, mission, re-orientation, retreat or dis-orientation.

(ii) An operation is any manoeuvre taken in one leap with a unit that is not directly threatened with an offence by the immediately preceding move; or the acts of importation or deportation;

(iii) A mission is the manoeuvre of the H in one or two leaps for the purposes of ferrying the T, which may be made in one or two directions, excepting that the T can be carried only in one of the leaps and only in one direction of the move;

(iv) A re-orientation is any optional manoeuvre in evasion of an attacker upon due demand, in one leap;

(v) A retreat is any compulsory manoeuvre of either an N or T in evasion of an attacker, to the adjacent axis to the side's right in one leap;

(vi) A dis-orientation is any compulsory manoeuvre in one leap with a unit, to remove it from the theatre as being immobilised and made a casualty from the immediately preceding move;

(vii) Any echelon of the R shall have unlimited range, notwithstanding the natural range of the other unit, and the echelon may also be moved in one or two directions and in not more that two leaps by virtue of the R;

The occupation is defined as follows:

(i) An occupation is the entrenchment of the T in the key points of the opposite side, and shall be sustained if the occupation could not be dislodged in the immediately preceding move if in Symmetry or within two immediately proceeding moves of the opposing side if in Scramble, (ii) A sustained occupation unit shall be immune against all hostile moves (except ultimate) while it remains.

The offences are defined as follow:

(i) An offence shall be any demand by a higher unit upon a lower one of the opposing side to manoeuvre away from the demanding unit's scope in due deference;

(ii) An offending unit shall be referred to as the attacker, an axis to which an offence was directed as the target and a unit against which an offence had been executed as the object;

(iii) The demand of an attacker shall be for the lower unit to either re-orientate, retreat or dis-orientate;

(iv) An offence shall be permissible only if the target lies within the scope of the attacker;

(v) During offence, the hostile side shall indicate unambiguously in words or other symbols which of the three demands is intended and then indicate the target and the attacker whereupon due demand shall have been exerted by the relevant attacker;

(vi) The demand of retreat may be made only by an attacker whose manoeuvrability is not more than '3'; re-orientation may be demanded only by F; disorientation may be demanded only by an attacker whose offence potential is not less than '3'; while F may demand disorientation from any u-echelon whose manoeuvrability is not more than '3';

(vii) A unit under demand to retreat shall forfeit the basis for use in hostile moves and be compulsorily retreated away from the attacker unless the attacker is otherwise neutralized; if the retreat cannot be made and the attacker cannot be neutralized, the unit under the demand shall automatically disorientate;

(viii) A unit under demand to re-orientate will forfeit the basis for use in hostile moves and shall be said to be in distress until it is manoeuvred away from the scope of the attacker in all possible directions, or the attacker neutralized; if the unit in distress is not rescued in the next move then its entire formation may disorientate;

(ix) If a distressed unit is not rescued in the next move, and instead the distressed side makes a move with another unit, the attacking side may effect its disorientation as that side's own move or otherwise forfeit all basis for any hostile moves with other units while the demand for re-orientation remains mounted;

(x) A unit under demand to disorientate shall forfeit all basis for use in hostile moves and immediately comply with the demand;

(xi) Only one axis may be a target in one offence and all units on that axis shall be liable; except (at the demands of reorientation and dis-orientation on an i-echelon) where only the critical unit shall be liable and the remaining part of the echelon may be operated away from target as continuation of the move immediately following the offence;

(xii) No offence may be executed until each side has completed their first three moves.

The Orbit Influence are defined as follows:

(i) An orbit influence shall be the claim of an orbit of 25 axis, in a square, with the M or S so that any unit caught in the orbit may automatically disorientate; the claim shall be said to have been made only when declared at the playing turn of the relevant side; and may include an introductory manoeuvre of the claiming unit (whereby it is said to be introduced) as well as a launch, as part of the move;

(ii) The unit claiming an orbit shall also be referred to as attacker, any axis within the orbit as target, and a unit disorientated by the claim as object;

(iii) The orbit influence of the M shall be referred to as ultimate, to which any unit whether friendly or opposing shall be liable; and provided that the removal from theatre of and object is the turn of play of the attacked side;

(iv) The M may claim an orbit on targets distant from its location; but the central target of such orbit shall not lie beyond a range of four axes from the location of the M; provided manoeuvre to introduce ultimate shall not be made to an axis adjacent to one which a T or N is located;

(v) All units lying within the orbit of the M shall be liable once ultimate is invoked and the relevant orbit determined; thereafter the attacker shall be removed from the theatre as spent;

(vi) Any move which leaves an M of the opposing side in a situation where it could become object in the next move shall be termed a provocation;

(vii) Ultimate shall not be invoked unless the attacker is a member of an echelon; if an M in echelon is subjected to provocation and subsequently disorientated, its ultimate shall be automatically provoked, with an orbit whose central target shall be the axis of the M, and discharged accordingly;

(viii) The S shall have a constant orbit around its location, with the unit always located at the centre, and any axis in the orbit may be its target at any time;

(ix) The orbit influence of the S may be invoked repeatedly but only one unit may be object at one time.

The axial effects are defined as follows:

(i) The axial effect shall be an exaction with the N or T, so that appropriate opposing units located on an axis adjacent to its own may automatically disorientate; the exaction, which lasts only one turn, shall be said to have been made only when declared and at the playing turn of the relevant side; and may include an introductory manoeuvre of the exacting unit as part of the move, whereby the exaction is said to be introduced;

(ii) The unit exerting axial effect shall also be referred to as attacker, the axis to which the effect is directed as the target, and the unit disorientated by axial effect as object; a unit shall be said to be in disaster while an effect is being mounted on it;

(iii) A unit in disaster shall forfeit all basis for use in hostile moves; during the exaction upon it;

(iv) An introduced exaction shall not be obligatory upon the object; the unit in disaster may be salvaged by being reorientated away or by the neutralization of the attacker; or the exaction may even be rejected while the side in disaster makes an unrelated move;

(v) An "unintroduced" exaction shall be obligatory upon the object once declared; whereby the unit in disaster is required to automatically disorientate;

(vi) Only the H, B, F, and R are liable to axial effect and shall be individually affected when in u-echelon; axial effect upon an inapplicable unit shall not be proper move and therefore void;

(vii) The i-echelon of two F shall not be liable to the axial effect of one N or T; a declaration of axial effect upon two F on the basis of one N or T shall therefore be invalid as an axial effect and valued as a mere manoeuvre;

(viii) Any formation of u-echelon of the applicable units shall be liable to the axial effect of the u-echelons of N or T;

(ix) If two opposing units are located on axes which are commonly adjacent to a third axes, the applicable units of both sides shall be liable there, whereby such axis may be referred to as no-man's-land.

The game may be played as Symmetry or Scramble. In Symmetry, the theatre is level, axes symmetrically disposed and the commission of units pre-determined; these fixed attributes make symmetry more simple and straightforward than the Scramble version;

For Scramble, whose theatre shall have terrain with variable disposition of axes and levels, and whose units may be commissioned independently, the following shall apply in addition; namely;

a. The sides select the types of units they may commission to a maximum force of 70 points.

b. Excepting the T no unit may be moved onto or over an altitude of the 4th Level on a theatre;

c. However, the 4th level altitude shall not hinder the influence of ultimate or in any way alter the liability of units within an orbit.

d. The operation of a unit within a complex shall not count as a move if it was conducted as a continuing part of a move transferring the unit from an axis outside the into complex or of an action transferring the unit from the complex to an axis outside it;

e. No unit may be manoeuvred into a complex and out again in one move;

f. The T shall not be moved beyond an axis at the next immediate altitude in one move; the manoeuvre betwee levels shall only be along diagonals;

g. The M may not be manoeuvred beyond an axis at the next immediate altitude in one move.

h. An S located in a deep shall be immune against all Offences.

I claim:

1. An apparatus for playing a game comprising a base and a plurality of platforms divided into subsets of different colors, said platforms being adapted to be placed over said base, and each one of said plurality of platforms having means for slidably connecting the platform to said base, the distance between the bottom surface of each said platform and said base being independently subject to selective setting at any said distance from said base within a predetermined range of distances, said means for slidably connecting each of said platforms to said base including an elongated projection from one of said base and said platform, and a corresponding elongated recess in the other of said platform and base engageable with said projection, said projection and said recess being sized and positioned such that the extent of engagement of said projection in said recess is variable to provide telescopic engagement therebetween, said range of distances being determined by the length of said projection that is received in said recess, structures of varying distances from said base being subject to assembly using said platforms, and a set of playing pieces adapted to rest on said platforms.

2. An apparatus as claimed in claim 1, wherein each said platform is square in the plan view.

3. An apparatus as claimed in claim 1, wherein all of said platforms are the same dimensionally.

4. An apparatus as claimed in claim 1, wherein the platforms are of sufficient number to cover the base.

5. An apparatus as claimed in claim 1, wherein the platforms are dimensioned to make a structure without gaps between the platforms.

6. An apparatus according to claim 1, wherein said base is square and surrounded by a raised rim.

7. An apparatus as claimed in claim 1, and further comprising a set of plan pieces for placement on said platforms, said platforms being divided into sub-sets of platforms, the platforms of each said sub-set having a top surface of the same color.

8. An apparatus for playing a game comprising a base having a top surface and a plurality of platforms each platform having a bottom surface and being adapted to be placed over said base, and each one of said plurality of platforms having means for slidably connecting the platform to said base, the distance between the bottom surface of each said platform and said base top surface, being independently subject to selective setting at any said distance from said base within a predetermined range of distances, said means for slidably connecting each of said platforms to said base including elongated projections from said base top surface and from said platform, and recesses in the projections of one of said platforms and base, said recesses being engageable with said projections on the other of said platforms and base, each said projection and recess being sized such that the extent of engagement of said projection in said recess is variable over said predetermined range to provide telescopic engagement therebetween, said range of distances being determined by the length of said projection that is received in said recess, structures of varying distances from said base top surface being subject to assembly using said platforms, and a set of playing pieces adapted to rest on said platforms.

* * * * *